US005816163A

United States Patent [19]

Achelpohl et al.

[11] Patent Number: 5,816,163

[45] Date of Patent: Oct. 6, 1998

[54] PROCESS FOR CLEANING A DOCTOR BLADE DEVICE FOR A RINSABLE COLOR INKING UNIT OF A ROTARY PRESS

[75] Inventors: Fritz Achelpohl; Günter Rogge, both of Lienen; Ludger Ottenhues, Tecklenburg; Lutz Telljohann, Lengerich, all of Germany

[73] Assignee: Windmöller & Hölscher, Lengerich, Germany

[21] Appl. No.: 780,069

[22] Filed: Dec. 23, 1996

[30] Foreign Application Priority Data

Dec. 22, 1995 [DE] Germany ..... 195 48 535.1

[51] Int. Cl.[6] ..... B41C 33/00

[52] U.S. Cl. ..... 101/483; 101/424

[58] Field of Search ..... 101/424, 425, 101/483

[56] References Cited

U.S. PATENT DOCUMENTS

| | | | |
|---|---|---|---|
| 4,369,734 | 1/1983 | Preuss | 101/425 |
| 4,967,664 | 11/1990 | Iijima | 101/425 |
| 5,003,877 | 4/1991 | Yano et al. | 101/425 |
| 5,213,044 | 5/1993 | Elia et al. | 101/483 |
| 5,367,982 | 11/1994 | DeMoore et al. | 101/424 |
| 5,402,724 | 4/1995 | Yaeso et al. | 101/425 |

FOREIGN PATENT DOCUMENTS

| | | |
|---|---|---|
| 0612618A2 | 8/1994 | European Pat. Off. . |
| 19516223A1 | 11/1996 | Germany . |
| 19516224A1 | 11/1996 | Germany . |

*Primary Examiner*—Edgar S. Burr
*Assistant Examiner*—Anthony H. Nguyen
*Attorney, Agent, or Firm*—Evenson, McKeown, Edwards & Lenahan, PLLC

[57] ABSTRACT

A doctor blade device of a rinsable ink application device of a rotary press is cleaned by first pumping ink back out of an ink chamber of the doctor blade device via a discharge line into an ink tank. Subsequently, from a solvent tank and via a feed line, solvent is directed into the ink chamber. During a predetermined time span, solvent is directed via the discharge line into the ink tank. Subsequently, the solvent, which is still contaminated with ink, is pumped into a contaminant chamber within a predetermined time span. The solvent flow from the solvent tank is interrupted and the solvent is pumped into the contaminant tank. Fresh solvent is then pumped via the feed line into the ink chamber, the suction line to the solvent tank is closed, and the solvent is pumped via the feed and discharge lines within a closed rinsing cycle for a predetermined amount of time. The circulating solvent is then directed into the contaminant tank.

4 Claims, 1 Drawing Sheet

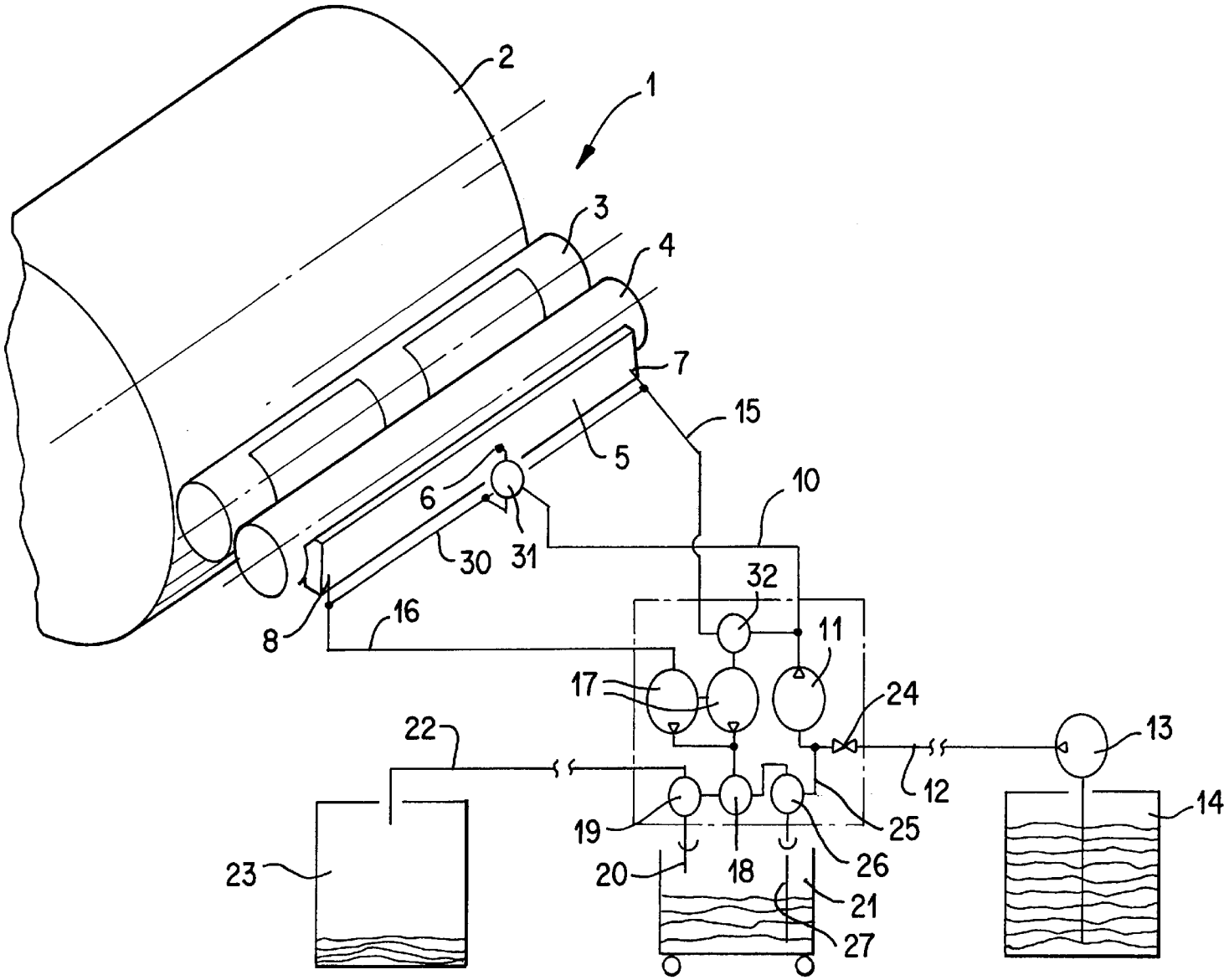
1
2
3
4
5
6
7
8
10
11
12
13
14
15
16
17
18
19
20
21
22
23
24
25
26
27
30
31
32

PROCESS FOR CLEANING A DOCTOR BLADE DEVICE FOR A RINSABLE COLOR INKING UNIT OF A ROTARY PRESS

BACKGROUND OF THE INVENTION

1. Field of the Invention

This invention relates to a process for cleaning a doctor blade device for a rinsable color inking unit of a rotary press. A doctor blade carrier is provided with a longitudinally extending groove. Two doctor blades, applicable to an ink application roll, are attached to the carrier such that they are parallel to each other. The color application roll, the groove of the doctor blade carrier and a seal provided at the end of the carrier abut against an ink chamber with lines for feeding ink into and discharging the ink from the ink chamber. The rotary press also includes application devices for pressing the doctor blade carrier against the ink application roll so that after the ink has been pumped out of the ink chamber, it is rinsed with a solvent.

2. Description of Related Art

A process of this type is known from U.S. Pat. No. 5,402,724. In the known process, the direction of delivery by a pump which directs the solvent, during the rinsing phase, through the ink chamber is reversed several times. As a result of the change in the flow direction of the solvent, a thorough rinsing of the ink chamber is obtained.

Upon completion of the printing application or during a printing ink change, it is necessary to clean the doctor blade devices. All ink residues must be removed from the ink chamber and from the screen roller. The feed and discharge lines for the ink, moreover, must also be cleaned.

SUMMARY OF THE INVENTION

It is an objective of this invention to create a process according to which all ink residues can be removed in a simple and thorough manner from both the ink chamber of the doctor blade device and the feed and discharge lines.

According to the invention, this objective is achieved by pumping ink from the ink chamber via the discharge line or discharge lines back into the ink tank and, subsequently, pumping solvent via the feed line or lines from a solvent tank into the ink chamber. The solvent is directed via the discharge line or the discharge lines, during a predetermined time span, into the ink tank. Subsequently, the solvent, which is still contaminated by ink, is pumped during a predetermined time span into the contaminant tank. The flow of solvent from the solvent tank is interrupted, and the solvent is pumped into the contaminant tank. Fresh solvent is then pumped, via the feed line, into the ink chamber. The suction line to the solvent tank is closed and the solvent is pumped via the feed and discharge lines through a closed rinse cycle for a certain amount of time. Subsequently, the solvent present in the cycle is directed into the contaminant tank.

The individual steps for cleaning the doctor blade device and the accompanying lines may be carried out in succession. The cleaning process, therefore, may be computer-controlled. During the first cleaning phase, the solvent that still contains a great amount of ink is directed into the ink tank, since the dilution of the ink resulting from this action may be tolerated. Excess solvent becomes volatile again. The additional procedural steps are performed to attain both a thorough cleaning of the doctor blade device and economical consumption of the solvent. The solvent that has been directed into the contaminant tank and that is rich in color must be disposed of in a special manner.

Advantageously, the ink in the ink chamber is directed through a centrally located feed line and is again suctioned out by lateral drainage lines.

In order to clean the ink feed line completely, one of the drainage lines at an end is blocked for a certain amount of time during each rinsing phase and solvent is suctioned off through the feed line.

If the printing operation is again resumed with new ink, then, advantageously, during the application of the new ink, it is pumped into the contaminant tank for a predetermined amount of time. As a result, the new ink will not be diluted too greatly by solvent residues. The ink, which flows into the contaminant tank, can be observed so that the drainage process can be stopped when the color in the cycle is of impeccable quality.

According to a preferred embodiment of the invention, provisions are made so that while draining the ink from the ink chamber, the ink application roller is driven at a continuous rate of revolution that is less than that during the printing operation.

Additionally, in order to increase the cleaning effect, provisions are made so that during the rinsing phases, the ink application roller is driven at a higher rate of revolution than during the printing operation. The higher revolution rate produces turbulence that facilitates the cleaning process.

During the rinsing phase, the direction of rotation of the ink application roll is reversed at least once.

A device for carrying out the inventive process includes a unit which has pumps and valves. The pressure side of a first pump is connected with the feed line to the ink chamber of the doctor blade device. The suction side of the first pump is connected with the solvent tank. The suction side of a second pump is connected with the discharge line or lines from the ink chamber. Switchable valves are provided so that the pressure side of the second pump can be connected either with the ink tank or with the contaminant tank. In order to make circulation of the cleaning fluid possible, the pressure side of the second pump may be connected with the suction side of the first pump by valves.

BRIEF DESCRIPTION OF THE DRAWING

An embodiment of the invention is explained in greater detail in the subsequent text which refers to the drawing figure, in which the apparatus for cleaning a doctor blade device according to the invention is schematically illustrated.

DESCRIPTION OF THE PREFERRED EMBODIMENT

The figure shows a printing mechanism 1, including an inking roll 2, a printing roll 3 applicable to the inking roll and a screen roll 4 that can be applied to the printing roll. A doctor blade carrier 5, including a profile bar, can be applied to the screen roll 4. The bar of the doctor blade carrier 5 is provided with a groove, forming the interior of an ink chamber. A bore 6 for supplying the printing ink opens into a central area of the groove. In lower end areas of the groove, bores 7 and 8, which discharge the printing ink, are located.

The front surfaces of the groove edges of the doctor blade carrier form roof-shaped slopes. On these front surfaces, doctor blades are mounted. These doctor blades may be applied to the screen roll 4 for the purpose of carrying out a scraping or stroking action. On the sides of the doctor blade carrier, seals are arranged in order to seal the ink chamber interior from the screen roll 4.

Doctor blade devices of this type are known, for example, from German Patent Application Nos. 19,516,223.4 and 19,516,224.2, to which reference is made for the purpose of describing the doctor blade device in greater detail.

The feed bore 6 in the profile bar of the doctor blade carrier 5 is connected with the pressure side of a pump 11 by a line 10. A piston pump is preferably used. The suction side of the pump 11 is connected by a line 12 with an additional pump 13 having a suction tube which extends into a solvent tank 14.

The bores 7 and 8 are connected by lines 15 and 16 with the suction sides of pumps 17 that are coupled with each other. The pressure sides of the pumps 17 can be connected selectively via valves 18 and 19 with a line 20 that opens into the ink tank 21. The line 20 can be connected with a line 22 that opens into the contaminant tank 23.

In the line 12, a check valve 24 is arranged.

The section of the line 12, which is located between the check valve 24 and the suction side of the pump 11 can be connected with the valve 26 via a line 25. The suction side of the pump 11 can be connected by the line 25 with the suction tube 27 that extends into the ink tank 21.

The return lines 15 and 16 are connected with each other by a line 30. In the feed line 10, a valve 31 is arranged. The line 10 can be selectively applied either to the bore 6 or the line 30 by this valve 31.

In the return line 15, valve 32 is arranged so that the pressure side of the pump 11 can be connected with the suction side of the pump 17.

The pressure sides of the pumps 17 can be connected with the suction side of the pump 11 by the valves 18 and 26.

The valves 18, 19, 26, 31 and 32 are controllable directional valves such as, for example, magnetic valves. The check valve 24 can be remote-controlled.

The valves and pumps are controlled with a computer by a control device, not shown, so that the pumps and valves can be operated in accordance with predetermined programs.

Typical positions of the pumps and valves during the operation and the rinsing phases are explained subsequently in greater detail:

PRINTING OPERATION

1. During a printing operation, the check valve 24 is blocked and the pump 11 is connected with the suction tube 27 via the directional valve 26 so that the pump directs ink from the ink tank 21 via the line 10 and the valve 31 via the feed bore 6 into the ink chamber. The printing ink is pumped back into the ink tank 21 via the line 20 by the discharge lines 15 and 16, the pumps 17, and the directional valves 18 and 19.

2. In order to prepare for a printing ink change, the ink is pumped from the cycle back into the ink tank 21. To do this, the pump 11 is stopped and the pumps 17 guide the printing ink via the directional valves 32, 18 and 19, as well as the line 20, back into the ink tank 21. This pumping-out phase may, for example, last approximately five seconds. During the pumping-out phase, the screen roll 4 is driven with a continuous rate of revolution that is less than its rate of revolution during the printing operation.

3. After the printing ink has been pumped off, the first rinsing phase is introduced. For this purpose, the check valve 24 is opened and, via the pumps 11 and 13, the feed line 10, and the directional valve 31, the solvent is pumped through the bore 6 into the ink chamber. The solvent is directed via the lines 15 and 16, the pumps 17, the valves 18 and 19, and the line 20 into the ink tank 21. During this first rinsing phase, the screen roll 4 is driven at a rate of rotation that is higher than the rate of rotation during the printing operation. After five seconds, for example, this first rinsing phase is interrupted, and the introduction into the ink tank 21 of the solvent, which is greatly enriched with printing ink, is stopped.

4. In the subsequent rinsing phase, fresh solvent is pumped via the pumps 11 and 13 from the solvent tank 14 into the ink chamber. The directional valves 18 and 19, however, have been readjusted in such a way that the solvent enriched with printing ink is directed into the contaminant tank 23 via the line 22. After approximately five seconds, during which the screen roll also rotates at a high rate of rotation, the second rinsing phase is brought to an end. For this purpose, the directional valve 24 is blocked and the pump 11 is turned off. The solvent still present in the cycle is pumped via the pumps 17, the valves 18 and 19, and the line 22 into the contaminant tank 23. Also, during this pumping-out phase, which lasts approximately three seconds, the screen roll is driven at a high rate of speed.

5. In order to prepare for the subsequent intensive rinsing operation, the check valve 24 is again opened and the pumps 11 and 13 carry fresh solvent into the ink chamber via the line 10 and the directional valve 31. After the ink chamber has been filled with fresh solvent, the check valve 24 is closed and the valves 18 and 26 are set in such a way that the pressure sides of the pumps 17 are connected with the suction side of the pump 11. Then, the pumps 11 and 17 are operated to cause the solvent for the intensive rinsing operation to travel through the cycle in such a way that the solvent is introduced into the ink chamber through the line 10, the valve 31, and the bore 6. The solvent is again suctioned off through the return lines 15 and 16. During the intensive rinsing operation, the screen roll 4 is driven at a high speed. The direction of rotation of the screen roll may be reversed, for example, after approximately fifteen seconds, so that a particularly intensive rinsing can be achieved.

The filling of the ink chamber with the solvent prior to the intensive rinsing operation can be measured by the number of strokes of the pump 11. For example, the filling process may last approximately five seconds.

The intensive rinsing phase, during which the cleaning agent is introduced into the cycle, may last approximately sixty seconds. The direction of rotation of the doctor blades is advantageously reversed after fifteen seconds.

During the intensive rinsing phase, in order to clean the line section between the pressure side of the pump 11 and the directional valve 32, it is possible to briefly connect the pressure side of the pump 11 with the suction side of the pump 17 by the directional valve 32.

6. Intensive rinsing of the return lines 15 and 16 is accomplished by switching the feed line 10 to the line 30 via the directional valve 31 so that a rinsing of the return lines 15 and 16 in a shortened cycle takes place.

7. During the pumping off of the ink, in order to empty the feed line 10, the feed line 10 is switched via the directional valve 32 to the suction side of the pump 17 while the pump 11 is stopped.

Accordingly, during the rinsing phases, the line 10 may be rinsed out by solvent counterflow.

8. Upon completion of the intensive rinsing process, the solvent is pumped out of the cycle into the contaminant tank 23 via the pumps 17, the valves 18 and 19 and the line 22, while the check valve 24 is closed and the pump 11 is stopped.

9. During the application of a new ink, the pump 11 suctions the ink out of the ink tank 21 via the directional valve 26. During the first phase of the application, the ink, which is returning via the lines 15 and 16, is pumped via the pumps 17. While the directional valves 18 and 19 and the line 22 are in the appropriate positions, the ink is directed into the contaminant tank 23 until the ink is sufficiently free of solvent. Subsequently, the directional valves 18 and 19 are readjusted in such a way that the ink cycle adjusts during the typical printing operation.

We claim:

1. A process for cleaning a doctor blade device for a rinsable ink application device of a rotary press including a doctor blade carrier provided with a longitudinally extending groove on which two parallel doctor blades are attached, the doctor blades being applicable to an ink application roll and, together with the ink application roll, forming an ink chamber, and lines for introducing ink into and removing ink from the ink chamber, comprising the steps of:

pumping the ink out of the ink chamber via at least one discharge line back into an ink tank, pumping solvents out of an intermediate solvent tank through a feed line and into the ink chamber, directing the solvents via the at least one discharge line into the ink tank during a predetermined time span while driving the ink application roll at a rate of rotation that is higher than during a printing operation, pumping solvent that is still contaminated with ink into a contaminant tank during a predetermined time span, interrupting solvent supply from the solvent tank as the solvent is pumped into the contaminant tank, pumping fresh solvent via the feed line into the ink chamber, closing a suction line to the solvent tank, pumping the solvent via the feed and discharge lines within a closed rinse cycle for a predetermined time span, and reversing a direction of rotation of the ink application roll at least once, and directing the solvent, present in the cycle, into the contaminant tank.

2. A process in accordance with claim 1, and further comprising the steps of directing the ink to the ink chamber through the feed line, which is located in a center of the ink chamber, and suctioning the ink out by lateral discharge lines.

3. A process in accordance with claim 1, and further comprising the step of rinsing the feed line out by solvent counterflow.

4. A process in accordance with claim 1, and further comprising the step of driving the ink application roll at a lower continuous rate of rotation while pumping the ink out of the ink chamber than during a printing operation.

* * * * *